US007044094B2

(12) United States Patent
Bosl-Flierl et al.

(10) Patent No.: US 7,044,094 B2
(45) Date of Patent: May 16, 2006

(54) VALVE-LIFT DEVICE FOR THE VARIABLE CONTROL OF GAS-EXCHANGE VALVES OF AN INTERNAL COMBUSTION ENGINE

(76) Inventors: Gerlinde Bosl-Flierl, Brunnenstrasse, Kaiserslautern (DE) 67661; Rudolf Flierl, Brunnenstrasse, Kaiserslautern (DE) 67661

( * ) Notice: Subject to any disclaimer, the term of this patent is extended or adjusted under 35 U.S.C. 154(b) by 0 days.

(21) Appl. No.: 11/169,066

(22) Filed: Jun. 27, 2005

(65) Prior Publication Data

US 2006/0021590 A1 Feb. 2, 2006

Related U.S. Application Data

(63) Continuation of application No. PCT/EP2003/014426, filed on Dec. 17, 2003.

(51) Int. Cl.
*F01L 1/18* (2006.01)

(52) U.S. Cl. ..... 123/90.44; 123/90.39; 123/90.2; 74/569

(58) Field of Classification Search ..... 123/90.16, 123/90.27, 90.31, 90.6, 90.39, 90.44, 90.2, 123/90.25, 90.26; 74/519, 559, 569
See application file for complete search history.

(56) References Cited

U.S. PATENT DOCUMENTS 5,189,998 A * 3/1993 Hara ..... 123/90.16
5,303,759 A 4/1994 Czech
5,373,818 A * 12/1994 Unger ..... 123/90.16
2002/0162522 A1 11/2002 Morm

FOREIGN PATENT DOCUMENTS

| | | |
|---|---|---|
| DE | 3833540 C2 | 4/1990 |
| DE | 4223172 C1 | 8/1993 |
| DE | 4322449 A1 | 2/1995 |
| DE | 4326331 | 2/1995 |
| DE | 19509604 | 9/1996 |
| DE | 19708484 | 9/1998 |
| EP | 0389609 B1 | 10/1990 |
| EP | 0780547 | 6/1997 |
| EP | 1039103 | 9/2000 |

* cited by examiner

*Primary Examiner*—Thomas Denion
*Assistant Examiner*—Ching Chang
(74) *Attorney, Agent, or Firm*—Jones Day

(57) ABSTRACT

A valve-lift device for the variable control of gas-exchange valves of an internal combustion engine is provided. The device includes a pivotable lever that is capable of being driven by a camshaft, the pivotable lever having an axis of rotation which can be displaced in a slotted-link track fixed to the housing, and a valve actuation means. The pivotable lever has, at one end, a roller which is driven by a camshaft and, at its other end, a slotted-link roller which is moved along a working curve in a slotted link, the slotted link being designed as an engagement surface of a valve actuation means. A center of rotation of the lever is provided between the roller and the slotted-link roller and the center of rotation of the rocker lever and a supporting axis of the valve actuation means is arranged on a vertical axis in an operating position. In order to set a valve lift, an axis of rotation is displaced in a slotted-link track fixed to the housing.

22 Claims, 1 Drawing Sheet

VALVE-LIFT DEVICE FOR THE VARIABLE CONTROL OF GAS-EXCHANGE VALVES OF AN INTERNAL COMBUSTION ENGINE

CROSS-REFERENCE TO RELATED APPLICATION

This application is a continuation of PCT Application No. PCT/EP2003/014426, filed on Dec. 17, 2003, which claims priority to German Patent Application 10261304.4, filed Dec. 27, 2002. The entire contents of these two applications are expressly incorporated herein by reference.

FIELD OF THE INVENTION

The present invention relates to an internal combustion engine with a valve-lift device and to a method for controlling or regulating the valve lifts in internal combustion engines.

BACKGROUND OF THE INVENTION

It is known that the achievement of a variable valve lift of the gas-exchange valve of internal combustion engines has a critical influence on the operating behavior and operating values of an internal combustion engine. DE 42 23 172 C1 discloses a device, in which, to achieve a variable valve lift from a cam of a camshaft, a moved rocker lever is guided in a long hole on a bolt fixed to the housing. The movement of the rocker lever in the long hole is in this case dependent on the position of the eccentric shaft. In general, to achieve a variable valve control, inter alia, known four-member valve mechanisms allow a continuous variation in the valve-lift profile when the internal combustion engine is in operation. A four-member valve mechanism of this type is described in U.S. Pat. No. 5,303,759, corresponding to DE 38 33 540 C2, and DE 43 22 449 A1 by means of a device for the actuation of the valves on internal combustion engines with a variable valve elevation curve. This device, according to U.S. Pat. No. 5,303,759, consists of a guide member acting at the same time as an output member which transmits the movement of an intermediate member to the valve or to the valve stem, the intermediate member being supported on the housing via a curved joint, and the curve, arranged on the intermediate member, of this curved joint having a catch-forming portion and a control portion, and the position of the curve belonging to this curved joint and supported on the housing or the position of the rotary joint of the cam being adjustable during operation. By contrast, in the device according to DE 43 22 449 A1, the intermediate member is additionally supported via a fourth curved joint, in order to define the paths of movement of the intermediate member unequivocally. U.S. Pat. No. 5,303,759, which also corresponds to EP 03 89 609 B1, discloses a further device for actuating the valve on internal combustion engines with a variable valve elevation curve, in which the joint between the intermediate member and the output member is designed as a rotary joint and the joint between the output member and the housing is designed as a sliding joint.

SUMMARY OF THE INVENTION

An object of an embodiment of the present invention is to provide a valve-lift device for the variable control of gas-exchange valves of an internal combustion engine, in particular, to obtain the highest rotational speeds, with the aim of reducing the high inertia forces and moments of inertia that occur at high valve accelerations and high rotational speeds due to the movement of the mechanism members of the valve-lift device and which act on the valve mechanism and the corresponding adjusting mechanism.

A further object of an embodiment of the present invention is to increase the maximum rotational speeds and valve accelerations of an internal combustion engine by means of known valve-lift devices, while at the same time increasing the useful life of such a valve-lift device and also reducing the wear.

These and further objects are achieved, according to an embodiment of the present invention, by means of a valve-lift device for the variable control of gas-exchange valves of an internal combustion engine, in which a pivotable rocker lever has, at one end, a roller which is driven by a camshaft and, at its other end, a slotted-link roller which is moved along a working curve in a slotted link, the slotted link being designed as an engagement surface of a valve actuation means, a center of rotation of the rocker lever being provided between the roller and the slotted-link roller, and the center of rotation of the rocker lever and a supporting axis of the valve actuation means being arranged on a vertical axis in an operating position, and in order to set a valve lift an axis of rotation being displaced in a slotted-link track fixed to the housing.

In this case the center of rotation of the rocker lever is provided at the, or near the, center of gravity of the rocker lever.

In another embodiment of the present invention the gas-exchange valves are actuated by a rocker lever which is pivotable about an axis and which contains, at one end, a roller driven by a camshaft and, at its other end, a slotted-link roller moved along a working curve in a slotted link, the slotted link being designed as an engagement surface of a valve actuation means in the form of a cam follower.

In principle, the valve-lift device according to an embodiment of the present invention is suitable for valves of all types. According to a preferred embodiment of the present invention, however, "a gas-exchange valve" means an inlet or outlet valve of an internal combustion engine.

To set a valve lift, the axis or the center of rotation of the rocker lever is displaced in a slotted link fixed to the housing.

Since, in an embodiment of the present invention, the center of rotation of the rocker lever is provided between the roller and the slotted-link roller, preferably, centrally located, and the center of rotation of the rocker lever consequently lies between the two rollers, the masses are compensated and only low inertia forces and low holding and adjusting forces act on the cam follower, since the axis of rotation of the rocker lever and the supporting axis of the cam follower are arranged on a vertical axis. The result of this is that the moved masses which act on the valve lift are very low and therefore high rotational speeds can be achieved.

A further advantage of an embodiment of the present invention is that the cam follower designed as a valve actuation means does not have a roller, but includes only, as an engagement surface, a slotted link with a working curve, on which the rocker lever rolls with its slotted-link roller, and, as a result, a low mass acts on the outlet or inlet valve, since, particularly for high rotational speeds, such a roller may have an adverse effect. Moreover, the main mass of the cam follower lies on the supporting axis and consequently does not participate in the movement so that the mass acting on the gas-exchange valve is low.

In an embodiment of the present invention, the valve-clearance setting is obtained by means of a slightly ascending ramp on the working curve of the slotted link of the cam follower.

A further advantage of an embodiment of the present invention with mechanical clearance compensation is that at least one setting shim is provided as a valve-clearance compensation element between the gas-exchange valve and the cam follower so that a low mass portion acts on the gas-exchange valve.

In an embodiment of the present invention is a mechanical valve spring or, for extremely high rotational speeds, a pneumatic valve spring or a pneumatic spring in conjunction with a mechanical valve spring may be used on the gas-exchange valve.

In an embodiment of the present invention, since the slotted-link roller acts on the cam follower with a transmission ratio to the supporting axis of the cam follower, which is predetermined by the arrangement, a large valve lift can be implemented in the case of a small deflection of the slotted-link roller on the working curve of the slotted link, the working curve of the slotted link being provided near the supporting axis of the cam follower. Where a multi-cylinder engine is concerned, all the rocker levers are mounted on a common axis and, to set a valve lift, the common axis is displaced in a slotted link fixed to the housing.

A further object of an embodiment of the present invention relates to a device for the variable valve-lift adjustment of gas-exchange valves of an internal combustion engine, that involves a pivotable lever, which is driven by means of a camshaft, and a valve actuation means, a rocker lever with a center of rotation having, at one end, a roller which is driven by a camshaft and, at its other end, a slotted-link roller which is moved along a working curve in a slotted link, the slotted link being designed as an engagement surface of a valve actuation means, and the center of rotation of the rocker lever and the supporting axis of the valve actuation means being arranged on a vertical axis at a zero lift or at a maximum lift of the gas-exchange valve.

In another embodiment of the present invention, the center of rotation of the rocker lever and the supporting axis of the valve actuation means are arranged on a vertical axis at the maximum lift of the gas-exchange valve. The maximum lift of the gas-exchange valves occurs particularly under full load and the maximum rotational speed of the internal combustion engine. This ensures that the moved masses acting on the valve lift are very low, particularly at the maximum rotational speed of the internal combustion engine, with the result that even higher rotational speeds than with hitherto known valve-lift devices can be achieved. Moreover, the reduction in the inertia forces and the resulting lower holding and adjusting forces within the valve-lift device lead to a reduction in wear, at the same time with an increased useful life of the elements of the valve-lift device.

This is additionally assisted in that the center of rotation of the rocker lever is provided at, or near the, center of gravity of the rocker lever, by virtue of which low holding and adjusting forces occur. The "center of gravity" means that point of the rocker lever at which the entire mass of its particles may be conceived as being combined.

With the aid of the device according to an embodiment of the present invention, rotational speeds from 0 to 8000 revolutions per minute, preferably up to 9000 revolutions per minute and, preferably, up to 10,000 revolutions per minute and more, can be achieved.

Furthermore, in another embodiment of the present invention, the center of rotation of the rocker lever is preferably arranged on an axis of rotation which, in order to set a valve lift, is displaced in a slotted-link track fixed to the housing. The slotted link in this case receives the axis of rotation, for example its ends, and thus constitutes its guide. The slotted link may, in principle, have any desired form which, however, a person skilled in the art selects in such a way that the axis of rotation of the rocker lever/rocker levers can be displaced preferably along a curve. The displacement of the axis of rotation in the slotted link may take place, in principle, by means of all the drives known to a person skilled in the art. Mention may be made at this point, by way of example, of mechanical, hydraulic, pneumatic, electrical or magnetic drive means or combinations thereof which may additionally have gear units. Electrical stepping motors, piezoelectric motors or hydraulic drive assemblies are preferably used. Preferable, the displacement of the axis of rotation in the slotted link takes place by means of one or more electrical or hydraulic actuating members (actuators).

According to an embodiment of the present invention, where a multi-cylinder internal combustion engine is concerned, preferably all the rocker levers of the inlet valves or of the outlet valves of a cylinder row are arranged on one axis of rotation. Depending on the form of construction of the internal combustion engine, the cylinders may be arranged in one row (in-line cylinder arrangement) or in two or more cylinder rows which are arranged at an angle to one another (V-arrangement or star arrangement). Preferably, for each cylinder row, at least one axis of rotation is provided for all the rocker levers of the inlet valves and at least one axis of rotation is provided for all the rocker levers of the outlet valves. Particularly, in the case of long cylinder rows, the common axis of rotation may also be multi-part and, if required, may be provided using a plurality of slotted links.

A further object of an embodiment of the present invention relates to an internal combustion engine which has at least one valve-lift device.

Moreover, an embodiment of the present invention relates to a method for controlling or regulating the lift of one or more inlet or outlet valves of an internal combustion engine, using one or more valve-lift devices, in which method the at least one axis of rotation of one or more rocker levers is displaced in at least one slotted link fixed to the housing, by means of at least one actuator, corresponding to the power requirement of the internal combustion engine.

The present invention is explained in more detail below by means of a preferred exemplary embodiment. Applicants note, however, that the subject matter of the claims is not limited to the details of the preferred embodiment.

Figure 1:
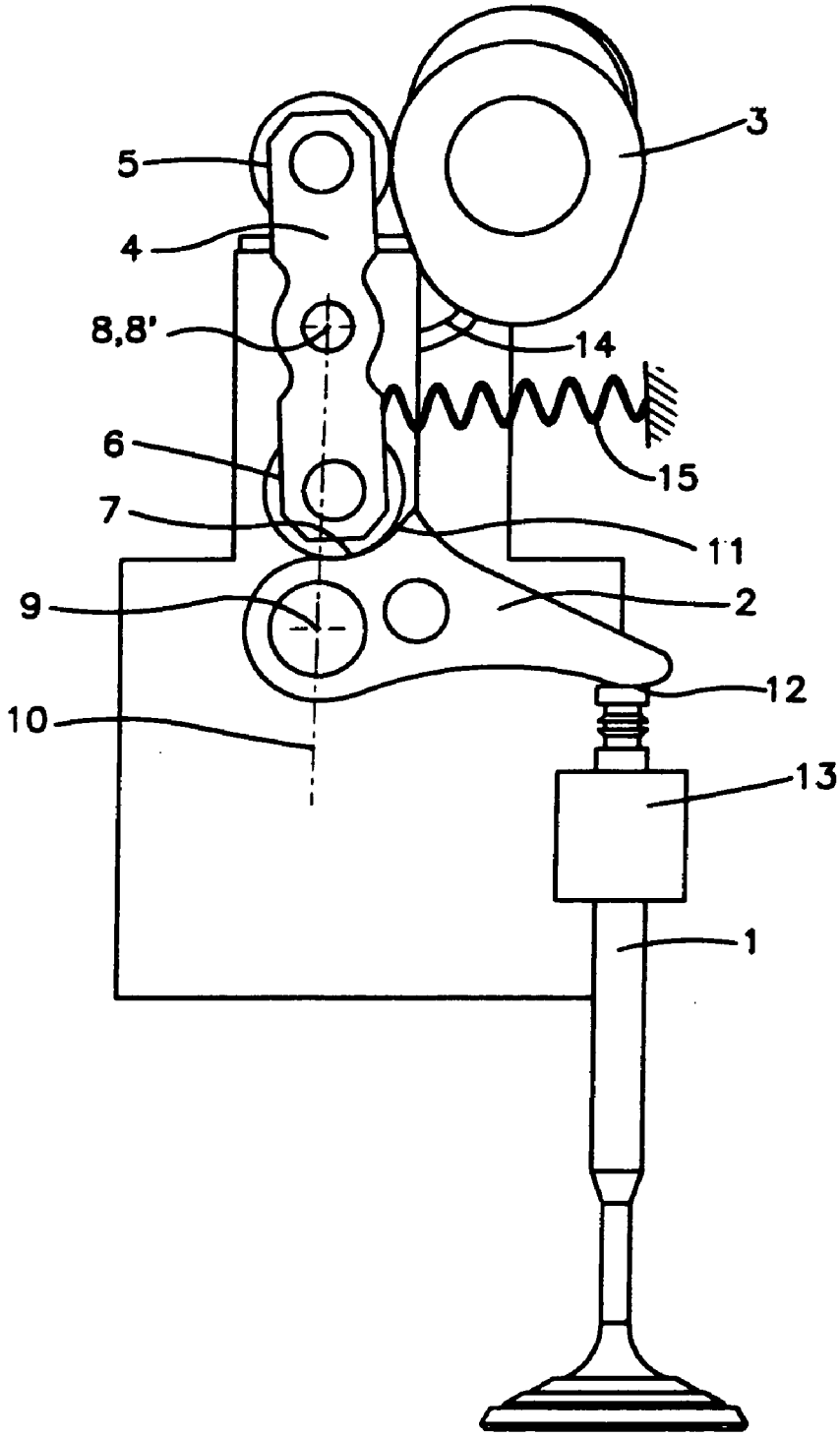
FIG. 1 shows a preferred embodiment of a valve-lift device according to the present invention.

The gas-exchange valve 1 is shown in FIG. 1 in the form of an inlet or outlet valve of an internal combustion engine. The displacement of the common axis takes place by means of an electrically or hydraulically actuated actuating member. In the valve-lift device for adjusting the gas-exchange valve 1, an intermediate lever designed as a rocker lever 4 is provided, which has in an axis a roller 5 and a slotted-link roller 6. By means of a camshaft 3, the rocker lever 4 is driven via the roller 5 and, during a rotation of the camshaft 3, is moved in such a way that the slotted-link roller 6 rolls along a working curve in a slotted link 7. The slotted link 7 is designed as an engagement surface of a cam follower 2 provided as a valve actuation means. The center of rotation 8 of the rocker lever 4 is arranged between the roller 5 and the slotted-link roller 6 in such a way that, at the center of rotation 8 of the rocker lever 4, the masses are compensated and low holding and adjusting forces occur, since the supporting axis 9 of the cam follower 2 and the axis of rotation 8' of the rocker lever 4 are arranged on a vertical axis 10. This means that the moved masses acting on the valve lift are low and high rotational speeds can be achieved.

DETAILED DESCRIPTION OF THE DRAWINGS

The valve-clearance setting of the valve-lift device takes place by means of a slightly ascending ramp 11 on the working curve of the slotted link 7. In order to set a variable valve lift, the center of rotation 8 of the rocker lever 4 is displaced by means of an actuator in a slotted link 14 fixed to the housing. The position of the center of rotation 8 in the slotted link 14 fixed to the housing is detected by a sensor, not illustrated.

For a valve mechanism with mechanical clearance compensation, at least one setting shim 12 designed as a valve-clearance compensation element is provided between the gas-exchange valve 1 and the cam follower 2. The slotted-link roller 6 advantageously acts on the cam follower 2 in a predetermined transmission ratio to the supporting axis 9 of the cam follower 2. In the case of a small deflection of the rocker lever 4 on the working curve of the slotted link 7, a large valve lift then occurs, the working curve of the slotted link 7 being provided near the supporting axis 9 of the cam follower 2. The gas-exchange valve 1 has provided on it a valve spring 13 which is designed either as a mechanical valve spring or, for extremely high rotational speeds, as a pneumatic spring. A pneumatic valve spring together with a mechanical valve spring may also be provided.

Furthermore, a spring element 15 is provided, by means of which the roller 5 of the rocker lever 4 is pressed against the camshaft 3.

LIST OF REFERENCE SYMBOLS USED

1 Gas-exchange valve
2 Cam follower
3 Camshaft
4 Rocker lever
5 Roller
6 Slotted-link roller
7 Slotted link
8 Center of rotation of the rocker lever 4
8' Axis of rotation of the rocker lever 4
9 Supporting axis of the cam follower 2
10 Vertical axis
11 Ramp
12 Setting shim
13 Valve spring
14 Slotted link fixed to the housing
15 Spring

What is claimed is:

1. A valve-lift device of an internal combustion engine comprising:

a pivotable lever capable of being driven by a camshaft, said lever having an axis of rotation displaced in a slotted-link track fixed to a housing and a valve actuation means, wherein said lever has, at a first end, a roller capable of being driven by the camshaft and, at a second end, a slotted-link roller capable of being moved along a working curve in a slotted link, the slotted link being designed as an engagement surface of the valve actuation means, a center of rotation of said lever being provided between the roller and the slotted-link roller, and the center of rotation of said lever and a supporting axis of the valve actuation means being arranged on a vertical axis in an operating position, and, wherein, in order to set a valve lift, an axis of rotation is displaced in the slotted-link track fixed to the housing.

2. The valve-lift device according to claim 1, wherein the center of rotation of said lever is provided at, or near, the center of gravity of said lever.

3. The valve-lift device according to claim 1, wherein the valve actuation means is designed as a cam follower.

4. The valve-lift device according to claim 1, wherein a valve-clearance setting is defined by a slightly ascending ramp on the working curve of the slotted link of a cam follower.

5. The valve-lift device according to claim 1, wherein in a valve mechanism with mechanical clearance compensation, at least one setting shim is provided between a gas-exchange valve and a cam follower.

6. The valve-lift device according to claim 1, wherein the slotted-link roller acts on a cam follower with a transmission ratio at a distance from the supporting axis of the cam follower.

7. The valve-lift device according to claim 1, wherein in a case of a small deflection of said lever on the working curve of the slotted link, a large valve lift is obtained.

8. The valve-lift device according to claim 1, wherein the working curve of the slotted link is provided near the supporting axis of a cam follower.

9. The valve-lift device according to claim 1, wherein a main mass of a cam follower lies on the supporting axis.

10. The valve-lift device according to claim 1, wherein a mechanical valve spring is provided on the gas-exchange valve.

11. The valve-lift device according to claim 1, wherein, for extremely high rotational speeds, a pneumatic valve spring is provided on the gas-exchange valve.

12. The valve-lift device according to claim 11, wherein a pneumatic valve spring together with a mechanical valve spring is provided.

13. The valve-lift device according to claim 1, wherein in a multi-cylinder engine, all of said levers of the inlet valve are lined up on one axis of rotation.

14. An internal combustion engine having at least one valve-lift device according to claim 1.

15. A method for controlling or regulating the lift of one or more inlet or outlet valves of an internal combustion engine, using one or more valve-lift devices according to claim 1, wherein the at least one axis of rotation of one or more of said levers is displaced in at least one slotted link fixed to the housing, by means of at least one actuator, according to the power requirement of the internal combustion engine.

16. A device for a variable valve-lift adjustment of gas-exchange valves of an internal combustion engine, said device comprising:

a pivotable lever capable of being driven by a camshaft, and a valve actuation means, wherein said lever has a center of rotation and includes, at a first end, a roller capable of being driven by the camshaft and, at a second end, a slotted-link roller capable of being moved along a working curve in a slotted link, the slotted link including an engagement surface of a valve actuation means, and wherein the center of rotation of said lever and the supporting axis of the valve actuation means being arranged on a vertical axis at a zero lift or at a maximum lift of the gas-exchange valve.

17. The device according to claim 16, wherein the center of rotation of said lever is provided at, or near, the center of gravity of said lever.

18. The device according to claim 16, wherein the center of rotation is arranged on an axis of rotation which, in order to set a valve lift, is displaced in a slotted-link track fixed to the housing.

19. The device according to claim 16, wherein the gas-exchange valve is an inlet or outlet valve.

20. The device according to claim 16, wherein in the case of a multi-cylinder internal combustion engine, all of the said levers of the inlet valves or of the outlet valves of a cylinder row are arranged on one axis of rotation.

21. An internal combustion engine having at least one device according to claim 16.

22. A method for controlling or regulating the lift of one or more inlet or outlet valves of an internal combustion engine, using one or more devices according to claim 16, wherein the at least one axis of rotation of one or more of said levers is displaced in at least one slotted link fixed to the housing, by means of at least one actuator, according to the power requirement of the internal combustion engine.

* * * * *